United States Patent [19]

Bourlet

[11] 4,336,742

[45] Jun. 29, 1982

[54] LOADER FOR MACHINE-PISTOL AND SIMILAR

[75] Inventor: Maurice V. Bourlet, Liege, Belgium

[73] Assignee: Fabrique Nationale Herstal, Herstal, Belgium

[21] Appl. No.: 89,318

[22] Filed: Oct. 30, 1979

[30] Foreign Application Priority Data

Nov. 16, 1978 [BE] Belgium ..... 57416

[51] Int. Cl.[3] ..... F41C 25/04

[52] U.S. Cl. ..... 89/34; 42/50

[58] Field of Search ..... 42/6, 50; 89/33 B, 33 BA, 89/34

[56] References Cited

U.S. PATENT DOCUMENTS

| | | | |
|---|---|---|---|
| 2,011,889 | 8/1935 | Birkigt | 42/50 |
| 2,483,837 | 10/1949 | Nettles | 42/50 |
| 3,314,182 | 4/1967 | Harvey | 89/33 B |

FOREIGN PATENT DOCUMENTS

| | | | |
|---|---|---|---|
| 554835 | 7/1932 | Fed. Rep. of Germany | 89/34 |
| 148756 | 10/1952 | United Kingdom | 89/33 BA |

*Primary Examiner*—Stephen C. Bentley

*Attorney, Agent, or Firm*—Bacon & Thomas

[57] ABSTRACT

Loader for a machine-pistol or the like, characterized in that it comprises substantially a prismatic tube closed at both ends and having, in the central portion of one of its longitudinal walls, a loading-feeding port, two symmetrical conveying devices being provided within the said tube and bearing each on an end wall of the latter.

1 Claim, 4 Drawing Figures

LOADER FOR MACHINE-PISTOL AND SIMILAR

BACKGROUND OF THE INVENTION

The present invention relates to a loader for a machine-pistol or the like.

The efficiency of a machine-pistol depends largely on the capacity of the loader provided therefor. Now, this capacity is principally limited by dimensional restrictions, i,e, the weapon provided with its loader requires a convenient transportability, a compactness, the allowance of any shooting position on the field and the like.

For a long time, this problem has given rise to numerous suggestions. The latter may be classified into two groups in relation either with the particular morphology of the ammunition or with a particular arrangement of the loader, the ammunition being a conventional one.

The present invention being related to the second group, only the latter will be described hereafter, it being however understood that it is not excluded to adapt this invention to a new ammunition.

As described hereabove, the capacity of the loader is limited principally owing to the space occupied. Another limitation results from the difficulty of obtaining, from a certain capacity, a correct transportation of the cartridges through the loader when shooting and inversely, an easy filling up of said loader.

An interesting solution is shown in the U.S. Pat. No. 2,624,241. It comprises providing a relatively long loader one end of which has a loading-feeding opening. Said loader is designed to be secured on the upper portion of the body of the weapon and in this axis thereof, said opening being located at right angles with a feeding area. The latter comprises a cylinder-shaped transfer member actuated through the bolt and being intended to receive every time a cartridge for pivoting it on 90°, thereby bringing it into the axis of the chamber.

However, the arrangements described in the above U.S. patent have numerous drawbacks.

Firstly, the capacity of the loader is still limited in that, the ammunition coming out at one of the ends thereof, it may extend only from about the center of the body towards the rear portion thereof or approximately from a plane perpendicular to the axis of the weapon and tangential to the free edge of the chamber. Then, with such a loader, it is difficult to obtain a correct a reliable feeding of the ammunition, except when limiting the length of the loader. In addition, the centre of gravity of the loader and accordingly of the weapon varies according to the number of remaining cartridges.

SUMMARY OF THE INVENTION

The purpose of the present invention is to prevent such drawbacks. For this purpose, it comprises a loader in the form of a prismatic tube closed at both ends and having, in the central portion of one of its longitudinal walls, a loading-feeding port, two symmetrical conveying devices being provided within the said tube and bearing each on one end wall of the latter.

BRIEF DESCRIPTION OF THE DRAWINGS

The present invention will be more clearly described hereafter, reference being made to the diagrammatic and non limitative enclosed drawings in which.

DESCRIPTION OF THE PREFERRED EMBODIMENT

Figure 1:
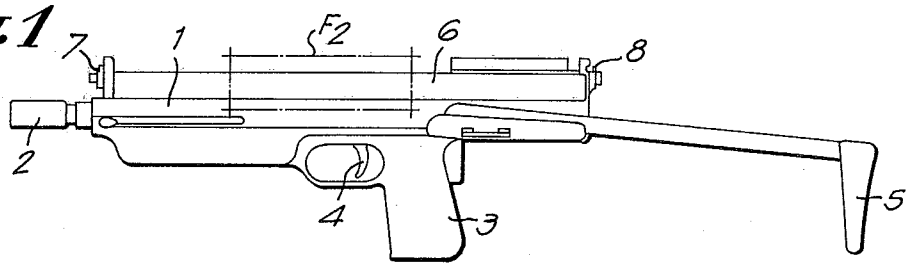
FIG. 1 is a side view of a machine-pistol provided with a loader according to the invention.
Figure 2:
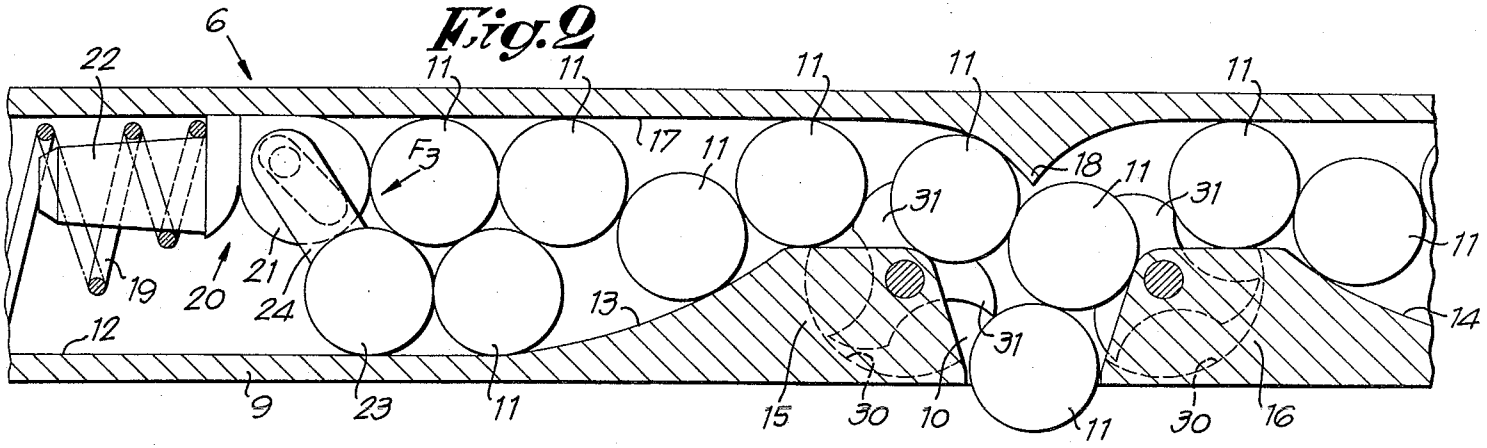
FIG. 2 is an axial section on an enlarged scale of the portion indicated by F2 in FIG. 1.
Figure 3:
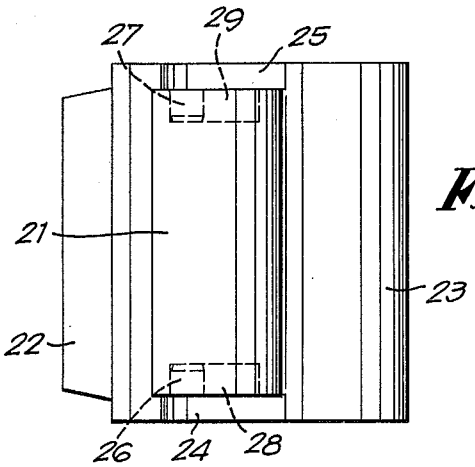
FIG. 3 is a view according to the arrow F3 for FIG. 2.
Figure 4:
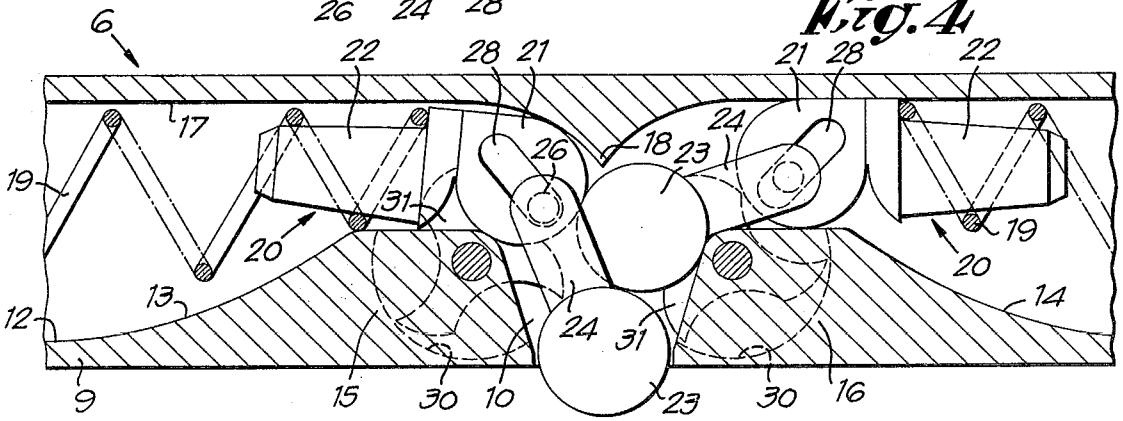
FIG. 4 shows a portion of FIG. 2, the loader being however emptied of the ammunition.

The machine-pistol shown in FIG. 1 comprises a body 1, a gun 2, a handle 3 with a trigger 4 and a telescopic shoulderpiece 5.

The loader 6 according to the invention is arranged to be secured on the upper side of the body 1 through any suitable means as shown diagrammatically at 7 and 8.

The loader 6 is in the form of a tube having a substantially rectangular cross-section and obturated at both its ends. The longitudinal wall 9 arranged to be applied against the body 1 is provided in its central portion with a port 10 allowing the introduction and the withdrawal of the cartridges 11. An index (not shown) locks the cartridges within the loader, said index being retracted when the loader is installed on the weapon.

The inner side 12 of wall 9 has two ramps 13 and 14 reaching each a solid mass 15 and 16 respectively surrounding the port 10.

The shortest distance between each of said solid masses and the opposite inner side 17 of the loader is very slightly gereater than the greatest outer diameter of the ammunition 11, whereas the distance between the walls 12 and 17 from the foot of the ramps 13 and 14 and up to the ends of the tube is slightly less than two times the said diameter.

The side 17 has a guiding projection 18 at rigth angles to the port 10.

A spring 19 driving back a conveyor 20 towards the center of the loader 6 bears against the end wall of each end of said loader.

Each conveyor 20 comprises a first cylindrical body 21 provided with a longitudinal tail 22 surrounded by the spring 19, and a second cylindrical body 23 connected with the first body and pivoting thereon. These connections and linkages are obtained through two arms 24 and 25 integral with the body 23 and carrying each a finger 26 and 27 respectively. Each of said fingers engages an oblong groove 28 and 29 respectively provided therefor in the corresponding end of the body 21.

Each of the said solid masses 15 and 16 comprises a cylindrical recess 30 in about which is freely pivoted a body with several vanes 31 the purpose of which is to reliably eject the ammunition 11 through the port 10 by taking them alternatively from the left and right portions of the loader.

The bodies 23 not only eject the two last pieces of ammunition, but they also facilitate the filling up of the loader by maintaining the correct relative position of the vanes 31.

Through these arrangements, there is obtained a loader having an optimum capacity and the centre of gravity of which does not vary when shooting without substantially affecting the space occupied by the weapon, while providing a very reliable feeding of the latter.

It is apparent that the above described loader may be variously modified without departing from the scope of the invention.

I claim:

1. Loader for a weapon, including a prismatic tube closed at both ends and having in the central portion of one of its longitudinal walls, a loading-feeding port, and two symmetrical ammunition conveying devices mounted within said tube and each comprising a spring one end of which bears on an adjacent end wall of said closed tube and the other end of which is connected to a plurality of interconnected cylindrical bodies in the tube to permit the complete emptying of the loader, said plurality of cylindrical bodies comprising a first cylindrical body having an oblong slot into which a radial finger of a second cylindrical body adjacent thereto is engaged in order to permit an angular movement and displacement of said second cylindrical body with respect to said first cylindrical body to a position spaced therefrom.

* * * * *